United States Patent [19]

Peck

[11] 4,121,068

[45] Oct. 17, 1978

[54] POLARITY REVERSING ELECTRICAL SWITCH

[75] Inventor: Vincent W. Peck, Waltham, Mass.

[73] Assignee: TRW Inc., Cleveland, Ohio

[21] Appl. No.: 772,378

[22] Filed: Feb. 28, 1977

[51] Int. Cl.[2] ..... H01H 13/28

[52] U.S. Cl. ..... 200/67 G; 200/339

[58] Field of Search ..... 200/67 G, 67 PK, 68, 200/73, 6 B, 6 BA, 6 BB, 239, 244, 246, 250, 284, 339

[56] References Cited

U.S. PATENT DOCUMENTS

| | | | |
|---|---|---|---|
| 3,225,153 | 12/1965 | Carling | 200/67 G X |
| 3,225,156 | 12/1965 | Salrbacker | 200/67 G |
| 3,403,236 | 9/1968 | Zoludow | 200/67 G |
| 3,974,347 | 8/1976 | Lockard | 200/239 X |
| 4,022,999 | 5/1977 | Brown | 200/6 BA |

*Primary Examiner*—Edward J. McCarthy

*Attorney, Agent, or Firm*—James R. O'Connor; Martin J. O'Donnell; Thomas C. O'Konski

[57] ABSTRACT

A four terminal polarity reversing electrical switch. Two of the terminals each have a pair of contact surfaces so located as to form opposed pairs of contacts, each pair including one contact from each terminal, when the terminals are positioned symmetrically with respect to each other. The other two terminals provide bearing surfaces supporting rotatable arms which extend intermediate corresponding contact surface pairs and which contact one of the other surfaces of the pairs when the arms are rotated to opposed positions.

20 Claims, 9 Drawing Figures

POLARITY REVERSING ELECTRICAL SWITCH

BACKGROUND OF THE INVENTION

A. Field of the Invention

The invention relates to electric switches and, more particularly, to polarity reversing electric switches.

B. Prior Art

Electric switches are used to interrupt power flow to a circuit, and to switch power from one portion of a circuit to another. Various characteristics of such switches, such as cost, size, reliability, and power handling capacity, among others, are dependent on the particular application for which the switches are used. The present invention is directed to low cost, mass produced switches with a moderate current capacity and used for applications such as energizing circuits, e.g., electric motor circuits, in automobiles and the like, and the prior art will thus be described with particular reference thereto.

Exemplary of the prior art in these applications are U.S. Pat. No. 3,671,693 issued June 20, 1972 to Guy M. Farrell; U.S. Pat. No. 3,746,809 issued July 17, 1973, to Martin Gaber; U.S. Pat. No. 3,601,568 issued Aug. 24, 1971 to Wesley T. Sorenson; U.S. Pat. No. 3,403,237 issued Sept. 24, 1968 to R. D. Wysong; and U.S. Pat. No. 3,519,775 issued July 7, 1970 to F. J. Weremey. These illustrate primarily single pole, double throw switches which utilize three terminals, namely, a common terminal and two switched terminals. As illustrated in the patent to Wysong, however, a pair of these switches may be utilized together to form a double pole, double throw switch; such a switch has six terminals, namely two common terminals and two pairs of switched terminals.

In forming a polarity reversing switch, the present practice is to utilize a double pole, double throw; six terminal configuration and wire alternate ones of the switched terminals together in the switch housing. This wiring or busing can constitute a significant part of the cost of manufacturing the switch, particularly where the switch is used in a large volume, low cost application such as the auto industry. Further, each additional element, such as a terminal, that is used in the switch increases not only the materials cost, but the cost of assembly as well and the latter element of cost is frequently a significant portion of the cost of manufacturing the switch. Thus, quantitatively small savings in materials or assembly, or both, can be significant in producing a more competitively priced switch.

OBJECTS OF THE INVENTION

Accordingly, it is an object of the invention to provide an improved electrical switch.

Further, it is an object of the invention to provide an improved polarity reversing switch.

Another object of the invention is to provide a polarity reversing switch which eliminates busing between switch terminals.

Yet another object of the invention is to provide a polarity reversing switch using only four terminals.

BRIEF DESCRIPTION OF THE INVENTION

In accordance with the present invention, an improved polarity reversing switch has first and second terminal pairs for connection into a circuit which is to be switchably and reversably energized from an electrical source such as a battery. One of the terminal pairs comprises first and second terminals having an elongated shank extending through the housing for connection to a circuit at one end thereof exterior to the housing and terminating at the other end, interior to the housing, in a cradle-forming configuration. Preferably, the terminals are each identically formed from a single stamping, the cradles being formed from pairs of fingers bent outwardly from the face of the terminal at one end thereof and defining, between pairs of the fingers, bearing surfaces on which a rocker arm rests.

The second pair of terminals comprises third and fourth terminals, each comprising an elongated shank extending through the housing and terminating at one end thereof exterior to the housing for connection to an electrical circuit and terminating at the other end thereof, interior to the housing, in a pair of contact surfaces for engagement with a contact arm. These terminals also are preferably identical in configuration and formed from a single stamping of metal. The contact surfaces on the third and fourth terminals are so arranged on the terminals, and the terminals are so positioned in the housing, that a first contact surface of each terminal is positioned spaced from, and opposed to, a second contact surface of the other terminal. Thus, within the switch, the contact surfaces are arranged in pairs, each pair including a first contact surface of one terminal and a second contact surface of the other.

First and second contact arms, each in the form of an elongated beam connected to a rocker base, are mounted in the respective common terminal cradles and extend from the first and second terminals such that the remote end of each beam lies intermediate one of the opposed contact surface pairs formed by the third and fourth terminals. A rocker arm carries a spring loaded follower which engages the contact arms and urges them against one contact surface or the other of the respective pairs of contact surfaces, dependent on the position of the rocker. When the contact arms are moved from one contact surface to the other of each pair, the order in which the first and second terminals are connected to the third and fourth terminals is effectively reversed. Thus, if an electrical source of a given polarity is applied to either one of the terminal pairs, the polarity of the source observed at the other pair of contact arms is reversed as the contact arms are moved by the rocker from one position to the other.

The construction of the terminals, and their positioning within the switch housing, not only eliminates a pair of terminals, but also obviates the wiring or busing which would normally connect them to other terminals. This greatly facilitates the manufacturing and assembly operation, and thereby lowers the costs. This result is achieved with only two different terminal configurations, and this further contributes to cost savings.

DETAILED DESCRIPTION OF THE INVENTION

The foregoing and other and further objects and features of the invention will be more readily understood when taken in conjunction with the accompanying drawings in which.

Figure 1:
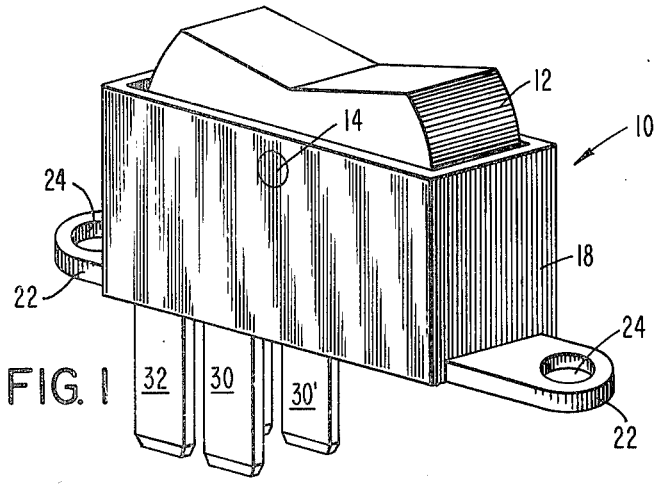
FIG. 1 is a pictorial view of one embodiment of a switch in accordance with the present invention.

In FIG. 1, a polarity reversing switch 10 in accordance with the present invention includes a rocker arm 12 pivotally mounted by means of pins 14 in apertures 16 (see FIG. 2) extending through the opposite walls of a housing 18. The housing is preferably of a one piece molded plastic which is slightly deformable from side to side to accommodate insertion of the pins 14 therein. Recesses 20 (FIG. 2) in the inner side walls of the housing surrounding the apertures 16 provide guideways to facilitate insertion of the pins. Ears 22 extending from the end walls of the housing accommodate through-holes 24 to enable mounting the switch.

Figure 2:
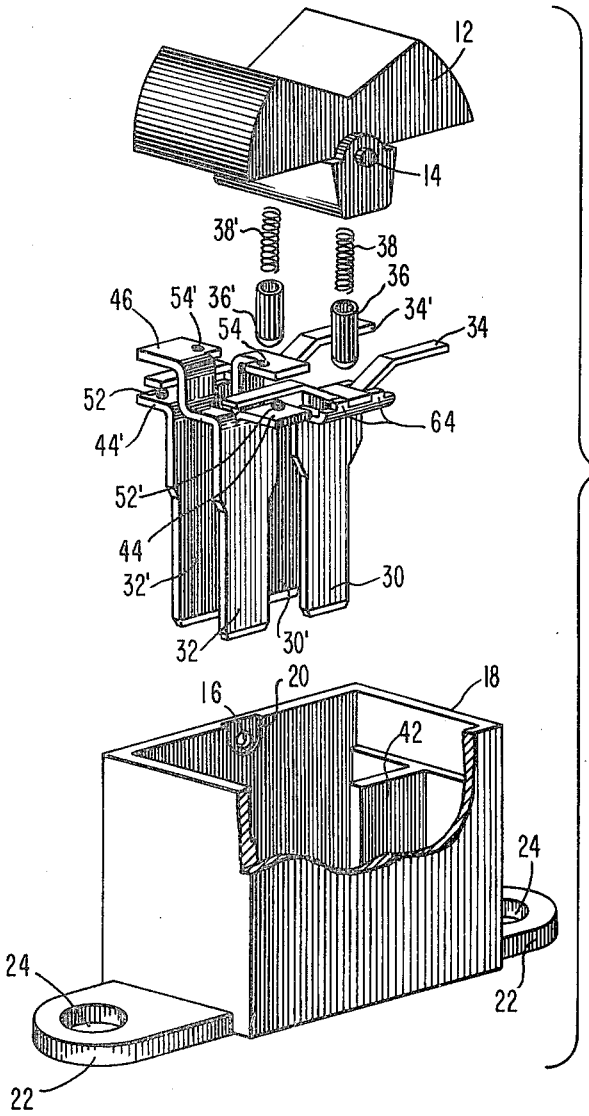
FIG. 2 is an exploded view of the switch of FIG. 1 showing the interior components and their positioning within the switch housing.
Figure 4:
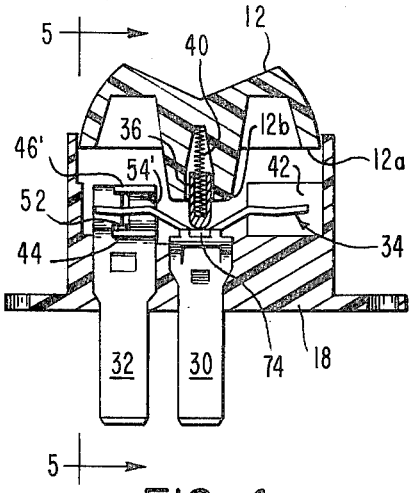
FIG. 4 is a side sectional view of the switch of the invention taken along the lines 4—4 of FIG. 5.
Figure 5:
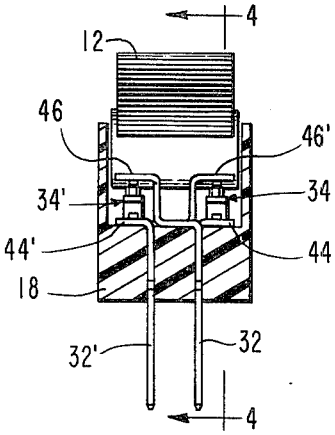
FIG. 5 is an end sectional view of the switch taken along the lines 5—5 of FIG. 4.

Referring now particularly to FIGS. 2, 4 and 5, a first pair of terminals 30, 30′ and a second pair of terminals 32, 32′ are mounted within the housing 18. Contact arms 34, 34′ extend between the terminals 30, 30′ and 32, 32′. Disposed above the terminals 30, 30′ for engagement with the contact arms 34, 34′ are followers 36, 36′ having hollow interiors for receiving springs 38, 38′ and seated in corresponding wells 40 (only one of which is shown in the drawings, the other being similarly located above the arm 34′). When the rocker arm 12 is rotated in one direction or the other about pins 14, the followers 36, 36′ engage corresponding surfaces of the arms 34, 34′ and pivot these arms into contact with opposed contact surfaces as will shortly be described in detail. A web 42 in the housing 18 limits rotation of the rocker 12 in the clockwise direction (as seen in FIG. 4) by engagement with a lower edge 12*a* of the rocker arm, and correspondingly limits rotation in the counterclockwise direction by engagement with a surface 12*b* of the rocker arm. This limits the force with which the arms 34, 34′ contact the terminals 32, 32′.

Figure 3A:
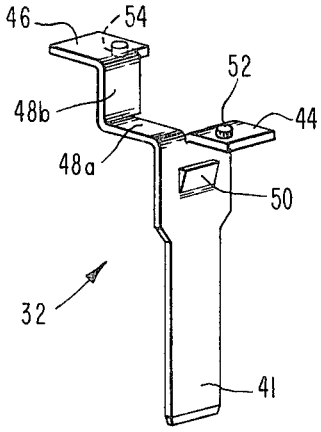
FIGS. 3A, 3B and 3C are pictorial views illustrating preferred forms of terminals in accordance with the present invention.
Figure 3B:
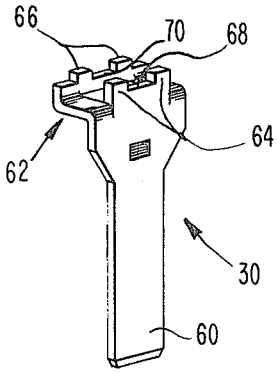
Figure 3C:
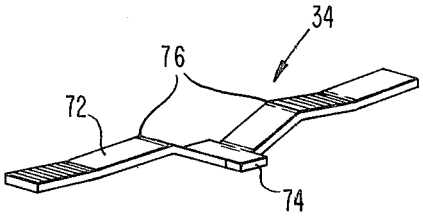

Turning now to FIGS. 3A through 3C, the terminals 30, 32 and arm 34 are there shown in detail; the corresponding terminals 30′, 32′ and arm 34′ are identical with the respective ones of these terminals and arms and therefore are not shown. In FIG. 3A, the terminal 32 has a broad faced shank portion 41 which extends outwardly of the housing (see FIG. 4) for connection to a circuit and which terminates at its upper end in first and second contact surfaces 44, 46, respectively. A connecting portion 48, comprising a horizontal portion 48*a* and a vertical portion 48*b*, interconnects the contact surfaces 44, 46. The upper portion of the terminal including the contact surfaces is thus configured in the form of a step, the surfaces 44 and 46 forming the lands of the step, and the vertical portion 48*b* of the connecting portion forming the rise of the step. A dimple 50, formed by partially punching through the surface of the shank 41, facilitates securing the terminal in the housing. Insert tabs 52, 54 provide wear surfaces for the terminals.

Figure 6A:
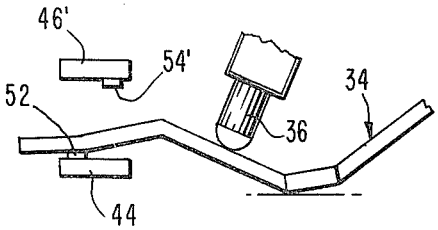
FIGS. 6A and 6B are diagrammatic views showing the contact arms in opposed switching positions.
Figure 6B:
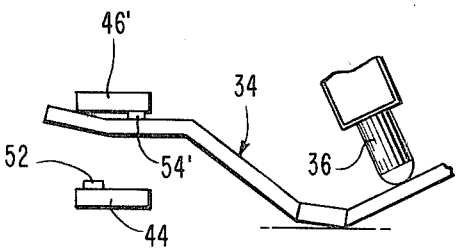

Similarly, the terminal 30 comprises an elongated, broad faced shank 60 extending through the housing 18 at the lower end thereof (FIG. 4) for connection into a circuit and terminating at the upper end thereof in a cradle 62 formed by first and second pairs of fingers 64, 66, respectively. The fingers of each pair are spaced apart from each other and define between them bearing surfaces 68, 70, respectively. The fingers and bearing surfaces rockably accommodate contact arm 34 (FIG. 3C) which comprises a thin, elongated beam 72 having a rocker base 74 extending outwardly from the sides thereof for mounting between the fingers 64, 66 of the terminal 30. That portion 76 of the arm adjacent the opposed sides of the base 74 is curved upwardly from the base so as to present a convex surface to the follower 36 (FIG. 4) when the switch elements are assembled. As the rocker arm 12 is rotated in one direction or the other, the follower 36 rides up on one part of the curved surface 76 or the other (see FIGS. 6A and 6B) respectively, and thereby rotates the contact arm in the cradle 62 into contact with opposed contact surfaces.

Referring back now to FIG. 2, the terminals 32, 32′ are mounted parallel to each other and symmetrically within the housing. Thus, the first, or lower contact surface 44 of each terminal extends outwardly of the housing away from the other terminal, while the second, or upper contact surface 46 of each terminal extends inwardly toward the other terminal and overlaps the lower contact surface of the other terminal. The upper contact surface of each terminal is thus complementary to the lower contact surface of the other terminal; together, they form mixed pairs of contact surfaces which are directly opposite each other, each pair comprising an upper contact surface 46 of one terminal and a lower contact surface 44 of the other terminal.

In the present embodiment of the invention, the switch is configured as a double pole, double throw, polarity reversing, center-off switch. Thus, in the absence of a force applied to the rocker 12 by the user, the elements of the switch are positioned as shown in FIG. 4, with the followers 40 directly above the rocker base 74 and the contact arms 34 intermediate the upper and lower contact surfaces of the terminals 32, 32′. In this position, an open circuit is presented between the terminals 30, 30′ and the terminals 32, 32′. When the user rotates the rocker 12 in the clockwise direction (as the switch is viewed in FIG. 4), the follower 36 rides on the forward sloping surface of the arm 34 and moves these arms into contact with the lower surfaces 44, 44′ of the terminals 32, 32′ (see FIG. 6A). In this position, the terminal 30 is electrically connected through contact arm 34 to the terminal 32 and the terminal 30′ is connected through arm 34′ to the terminal 32′. Conversely, when the rocker is rotated in a counterclockwise direction (as the switch is viewed in FIG. 4) the followers 36 ride upon the rearwardly sloping faces of the arms 34, 34′ and thereby rotate these arms into contact with the upper surfaces of the terminals 32, 32′, respectively. In this position, the terminal 30 is connected through contact arm 34 to the terminal 34′, while the terminal 30′ is connected through arm 34′ to the terminal 32 (See FIG. 6B). Thus, if a source of fixed polarity is applied to either terminal pair, for example, the terminal pair 30, 30′, the polarity of the source as observed at the terminals 32, 32′, will be the same or reversed dependent on whether the rocker 12 is rotated in the clockwise direction.

CONCLUSION

From the foregoing, it will be seen that I have provided an improved polarity reversing switch. The switch is of relatively simple construction, utilizes four terminals instead of the six conventionally used, and eliminates internal wiring and busing that has heretofore been utilized to provide the polarity reversal function. It is simple and economical to construct and can be expected to have a wide variety of applications, particularly in the low cost, mass production market.

It is to be understood that various changes may be made in the invention described herein without departing from either the spirit or the scope thereof and that the foregoing specific description is to be taken as illustrative only and not in a limiting sense, the scope of the invention being described with particularity in the appended claims.

Having illustrated and described my invention, I claim:

1. A polarity reversing electrical switch comprising
   A. a housing
   B. a first pair of identically formed terminals mounted in said housing and spaced apart from each other, each terminating at one end thereof in a contact for connection into an electrical circuit and having at the other end a cradle for rockably supporting a contact arm therein,
   C. a second pair of identically formed terminals mounted in said housing and spaced apart from each other and from said first pair, each terminating at one end in a contact for connection into said circuit and having at the other end integral first and second contact surfaces spaced apart from each other, said terminals being positioned in said housing such that the first contact surface of each terminal lies opposite the second contact surface of the opposite terminal to thereby form mixed pairs of contact surfaces, and
   D. a pair of contact arms rockably seated in said cradles of the first terminal pair and extending intermediate said contact surfaces, each arm being rotatable into contact with a corresponding pair of the opposed contact surfaces of the second terminal pair to thereby selectively electrically interconnect the first and second terminal pair in either of two configurations in accordance with the position of said arms.

2. A switch according to claim 1 which includes actuator means in contact with said arms for rotating both said arms simultaneously into contact with said contact surfaces.

3. A switch according to claim 2 in which said actuator means comprises
   A. a one piece molded rocker pivotally mounted in said housing and containing a pair of wells disposed above corresponding cradles of the terminals of said first terminal pair and opening toward said cradles,
   B. a follower fitting into each well of the pair, and
   C. a spring in each well urging the follower therein against one of said arms.

4. A switch according to claim 3 in which said arms present convexly curved surfaces to the respective followers and are positioned with the apices of said surfaces at said cradles to thereby define a neutral position in which the arms rest intermediate said contact surfaces.

5. A switch according to claim 4 in which said housing includes a web intermediate said contact arms and limiting motion of said rocker in either of two opposite directions to thereby limit the rotating force applied to said arms by said followers.

6. A switch according to claim 1 in which said contact arms are mounted parallel to each other for symmetric motion about the respective cradles.

7. A switch according to claim 6 in which each said contact arm comprises
   A. a thin elongated beam having a convexly curved surface intermediate the ends thereof for engagement with a follower, and
   B. a rocker base connected to said beam for positioning in a corresponding cradle for support thereby.

8. A switch according to claim 7 in which each said cradle is formed integrally with its corresponding terminal and comprises first and second spaced apart tab pairs extending outwardly from a surface of the terminal, the tabs of each pair being also spaced apart and defining an intermediate bearing surface for said rocker between them.

9. A switch according to claim 1 in which the contact surfaces of each terminal of said second terminal pair extend from said terminal on opposite sides of a plane longitudinally bisecting said terminal.

10. A switch according to claim 9 in which the terminals of said second terminal pair are each formed from an elongated shaft having a first portion thereof terminating in said first surface generally perpendicular to the face of said shaft and a second portion thereof laterally offset from said first portion and forming a stepped segment terminating in said second surface also generally perpendicular to said face.

11. An electrical switch comprising
   A. first and second terminals for connection into an electrical circuit,
   B. first and second contact arms in electrical contact with said first and second terminals, respectively, and mounted for movement between at least two positions corresponding to separate switching states,
   C. third and fourth terminals for connection into said circuit and each including first and second contact surfaces formed integral therewith, each of said terminals having a portion in the form of a step in which the contact surfaces form at least part of the lands and which are joined by an intermediate portion, the terminals and surfaces being positioned such that as each arm moves between said two positions, it moves from contact with a first contact surface of one of said terminals to a second contact surface of the other; and
   D. means for selectively moving said contact arms simultaneously between at least said two positions.

12. A switch according to claim 11 in which said third and fourth terminals comprise
   (1) a shank portion for connection into said circuit, and
   (2) said intermediate portion includes a connecting portion interconnecting said first and second contact surfaces.

13. A switch according to claim 12 in which said connecting portion includes a segment of reduced width intermediate said contact surfaces.

14. A switch according to claim 13 in which said third and fourth terminals are disposed such that the first contact surface of each of said terminals is opposite the second contact surfaces of the other and said arm is disposed intermediate said surfaces and moveable between them.

15. A switch according to claim 14 in which said third and fourth terminals are formed identical to each other.

16. A switch according to claim 11 in which said first and second terminals each comprise a body having (1) a shank portion for connection into said circuit, and (2) a cradle portion, connected to said shank portion, for supporting one of said arms therein.

17. A switch according to claim 16 in which each said cradle portion comprises first and second opposed pairs of fingers extending outwardly of said body and forming bearing surfaces between the fingers of each pair for supporting a contact arm for rockable motion thereon.

18. A switch according to claim 17 in which each said arm comprises (1) a thin elongated beam having one end thereof extending intermediate an elected pair of said contact surfaces, and (2) a rocker base mounted in said cradle and rockably supporting said beam for movement between the selected contact surfaces.

19. A switch according to claim 18 in which said means for moving the contact arms includes an actuator, comprising (1) a rocker arm mounted for pivotal movement in a housing and actuable by a user, (2) follower means mounted on said rocker arm and positioned for engagement with said contact arms, and (3) spring bias means urging said follower means against said arms.

20. A switch according to claim 19 in which said contact arms each have a curved surface intermediate the ends thereof convex to said follower means and extending along said arm on opposite sides of said cradle, said follower riding along said surface and rotating said arm into contact with one surface or another of the corresponding contact surface pair between which the arm extends in accordance with the actuation of said rocker arm by the user.

* * * * *